US008267068B1

(12) United States Patent
Low

(10) Patent No.: US 8,267,068 B1
(45) Date of Patent: Sep. 18, 2012

(54) METHOD FOR IMPROVED FUEL-AIR MIXING BY COUNTERCURRENT FUEL INJECTION IN AN INTERNAL COMBUSTION ENGINE

(76) Inventor: David Nicholson Low, Wilmington, DE (US)

( * ) Notice: Subject to any disclaimer, the term of this patent is extended or adjusted under 35 U.S.C. 154(b) by 327 days.

(21) Appl. No.: 12/455,294

(22) Filed: Jun. 1, 2009

(51) Int. Cl.
*F02M 61/14* (2006.01)

(52) U.S. Cl. ..... 123/468; 123/472; 123/590

(58) Field of Classification Search ..... 123/456, 123/472, 590, 298, 468
See application file for complete search history.

(56) References Cited

U.S. PATENT DOCUMENTS

| | | | | |
|---|---|---|---|---|
| 3,690,041 | A * | 9/1972 | Low | 95/225 |
| 3,803,805 | A * | 4/1974 | Low | 95/235 |
| 4,066,424 | A * | 1/1978 | Kilgren et al. | 95/233 |
| 4,084,640 | A * | 4/1978 | Allred | 166/259 |
| 4,167,158 | A * | 9/1979 | Martin et al. | 123/484 |
| 4,374,813 | A * | 2/1983 | Chen et al. | 423/243.08 |
| 4,494,515 | A * | 1/1985 | Brown | 123/527 |
| 4,665,877 | A * | 5/1987 | Manaka et al. | 123/472 |
| 4,757,787 | A * | 7/1988 | Risitano et al. | 123/25 A |
| 4,798,190 | A * | 1/1989 | Vaznaian et al. | 123/531 |
| 4,813,394 | A * | 3/1989 | St. Clair | 123/527 |
| 4,986,248 | A * | 1/1991 | Kobayashi et al. | 123/590 |
| 5,150,691 | A * | 9/1992 | Imajo | 123/531 |
| 5,249,557 | A * | 10/1993 | Katoh et al. | 123/305 |
| 5,377,646 | A * | 1/1995 | Chasteen | 123/527 |
| 5,512,097 | A * | 4/1996 | Emmer | 106/745 |
| 5,673,673 | A * | 10/1997 | Beck | 123/527 |
| 5,957,993 | A * | 9/1999 | Frigoli et al. | 701/104 |
| 6,065,459 | A * | 5/2000 | Stevens | 123/590 |
| 6,126,813 | A * | 10/2000 | Fersing et al. | 208/164 |
| 6,419,210 | B1 * | 7/2002 | Low | 261/62 |
| 6,467,465 | B1 * | 10/2002 | Lorts | 123/527 |
| 6,609,499 | B2 * | 8/2003 | Kabat et al. | 123/432 |
| 6,820,865 | B2 | 11/2004 | Low | |
| 2002/0043240 | A1 * | 4/2002 | Samenfink et al. | 123/298 |
| 2006/0157018 | A1 * | 7/2006 | Nakayama et al. | 123/298 |
| 2007/0163555 | A1 * | 7/2007 | Hong | 123/590 |
| 2007/0169760 | A1 * | 7/2007 | Rock | 123/527 |
| 2007/0261666 | A1 * | 11/2007 | Bertsch | 123/298 |
| 2010/0199645 | A1 * | 8/2010 | Telford | 60/295 |
| 2010/0281766 | A1 * | 11/2010 | Livshits | 44/458 |
| 2010/0300407 | A1 * | 12/2010 | Ravenhill et al. | 123/468 |

* cited by examiner

*Primary Examiner* — Erick Solis
(74) *Attorney, Agent, or Firm* — Connolly Bove Lodge & Hutz LLP

(57) ABSTRACT

A countercurrent spray nozzle injects fuel into the intake manifold of an internal combustion engine to give better mixing of fuel and air. Better mixing results in less NOx and less incomplete combustion of carbon.

8 Claims, 2 Drawing Sheets

METHOD FOR IMPROVED FUEL-AIR MIXING BY COUNTERCURRENT FUEL INJECTION IN AN INTERNAL COMBUSTION ENGINE

BACKGROUND OF THE INVENTION

The present invention relates to mixing fuel and combustion air in preparation for burning the mixture in an internal combustion engine.

Most modern four cycle engines in automobiles use an individual injector to meter fuel into combustion air for each cylinder. Each injector is placed to one side of its air duct and tilted to aim its spray at the intake valve for its cylinder. A fine spray of fuel from the injector starts at a point on the wall of a combustion air duct, mixes with combustion air and then moves through an intake valve and into the cylinder during the intake stroke for the cylinder. Refer to FIG. 1. During this period and while passing through the intake valve, the fuel must vaporize and mix with the air so that a combustible mixture is ready for ignition. Although the fuel is highly volatile, achieving a perfect stoichiometric mixture throughout the cylinder is difficult because of the short time allowed. A six-cylinder engine at 3000 rpm has approximately 0.03 seconds to accomplish mixing, vaporization, move the air-fuel mixture into the cylinder and compress the mixture before ignition. Some engines inject fuel only during the intake cycle (sequential injection). Other engines inject fuel each revolution, on the intake stroke and also when the intake valve is closed (simultaneous port injection).

Perfect mixing of fuel and combustion air is approached, but never achieved, on the macroscopic level. There are small "pockets" of gas in the cylinder where fuel concentration is above (rich) or below (lean) the ideal concentration for stoichiometric combustion. Rich pockets with a shortage of oxygen burn cool and result in incompletely burned carbon and uneconomical loss of energy. Lean pockets with an excess of oxygen burn at high temperature. At high temperatures inert N2 molecules dissociate into highly reactive N atoms which then combine with oxygen to form a range of several oxygen-nitrogen compounds commonly referred to as NOx. NOx is an undesirable air pollutant, and thought to take part in smog formation. While burned exhaust gas is often re-injected into the engine to complete combustion; this method can result in lower efficiency for the engine. Also, a catalytic converter is used to further combustion.

SUMMARY OF THE INVENTION

The primary objective of the present invention is to more uniformly mix fuel and air before the combustible mixture is ignited in the cylinder. With better mixing, a given air-fuel mixture will burn at a more uniform temperature with less NOx in smaller fuel-lean hot pockets and more complete combustion in smaller fuel-rich cool pockets.

Benefits from better mixing can be realized in any of several ways. A leaner mixture can be used to reduce fuel consumption and improve fuel economy at a constant level of NOx and wasted carbon levels, or the level of NOx and carbon pollutants can be reduced at constant fuel consumption. A less volatile fuel may be used with constant NOx and wasted carbon levels. Also, the load on the engine's catalytic converter is reduced.

The forgoing objective of better mixing can be achieved by introducing the atomized spray of fuel into the combustion air duct in a direction countercurrent to the direction of airflow during the cylinder's intake stroke. In its preferred embodiment, fuel 12 in FIG. 2 is injected at a point of the combustion air 3's highest velocity 32 which is usually near the duct's center, but may vary with configuration of the upstream duct. Refer to FIG. 2 as a typical but not limiting reversed jet (countercurrent) installation.

In traditional fuel injection, FIG. 1, fuel-air mixing results from turbulence as fuel 10 is injected in to manifold 4 and also from turbulence as fuel-air mixture 8 passes by an intake valve 5 and its seat 9. This invention uses these same traditional mixing mechanisms plus four additional distinct and different mechanisms to achieve improved mixing.

1. With this invention, atomized fuel spray 12 and the direction of air flow 32 are countercurrent, FIG. 2, and their individual velocities add to give a higher relative velocity between fuel spray 12 and peak velocity combustion air 32. This high relative velocity shatters droplets to smaller sizes ("PERRY'S CHEMICAL ENGINEER'S HANDBOOK" 6th ed., p. 18-53) giving them more surface area for heat transfer from combustion air and thus faster evaporation to a vapor. This high relative velocity compares to the traditional concurrent method FIG. 1 for fuel injection in which spray 10 enters stationary air or is concurrent with airflow 3 during the engine's intake stroke. During concurrent injection, relative velocity between droplets and air is the difference of the two velocities. Lower relative velocity allows larger drops and less surface for heat and mass transfer between the two phases.
2. Besides an increase of surface area, greater relative velocity between droplets and combustion air also increases the heat transfer coefficient between droplets and combustion air (Mc Adams "HEAT TRANSMISSION" 2nd ed., p. 251) compared to a lower relative velocity and lower heat transfer coefficient found with traditional concurrent fuel injection.
3. Placing a countercurrent jet 30 in FIG. 2 at a point of peak air velocity 32 puts the fuel closer to its final destination of being mixed with combustion air. By comparison, the traditional injection point on one side of duct 4 in FIG. 1 makes it necessary for some fuel to migrate across the diameter of duct 4.
4. An additional mechanism, which improves mixing when fuel is introduced by this invention, comes from the trajectory of droplets relative to counter flowing air. Even though countercurrent droplets 12 in FIG. 2 leave nozzle 30 at high velocity, their small size prevents significant movement directly into peak velocity air stream 32. Instead, droplets 12 are forced radially at high velocity in all directions toward the wall of duct 4. This forced movement disperses the droplets throughout combustion air for better early mixing.

All of these four mixing mechanisms take place before fuel 12 and air 3 in FIG. 2 pass by intake valve 5 and its seat 9 which makes them in addition to traditional mixing.

Countercurrent fuel injection is most effective when intake air is flowing; and therefore, engines with sequential injection will benefit most from its use.

BRIEF DESCRIPTION OF THE DRAWINGS

FIG. 3 also shows the outlet end of injector valve 21. When extension 33 in FIG. 3 is assembled and joined to injector valve 21, injector assembly 21A in FIG. 2 is formed. Injector assembly 21A in FIG. 2 implements this invention when installed in an engine with a matching intake manifold geometry.

DETAILED DESCRIPTION OF THE INVENTION

Figure 1:
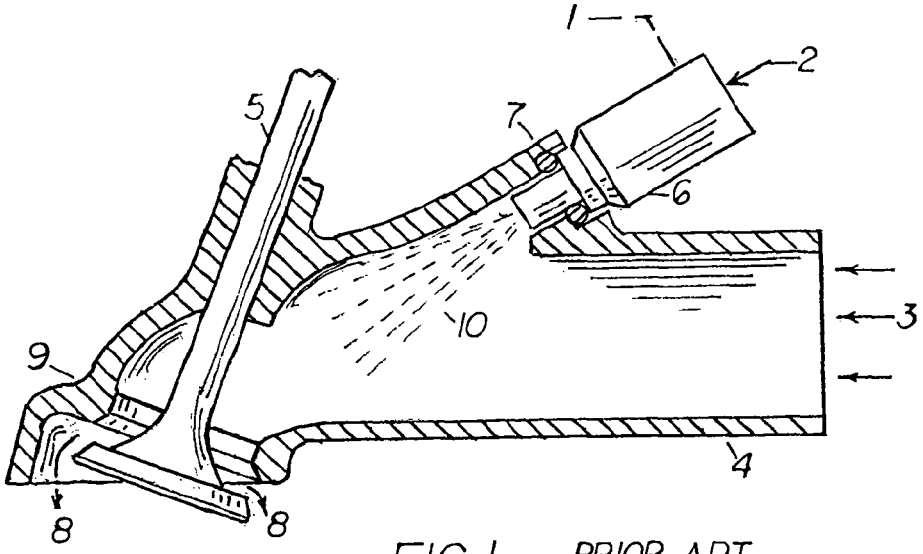
FIG. 1 PRIOR ART
FIG. 1 shows a conventional installation of a fuel injector 6 at one side (top) of its combustion air duct (intake manifold) 4 and its position relative to the engine's intake valve 5.

Conventional fuel injector 6 in FIG. 1 performs two functions. It acts as an on-off valve to meter fuel 2 as called for by a pulsating electrical signal 1 from the engine's controller. It also atomizes and sprays fuel 10 into combustion air 3.

Figure 2:
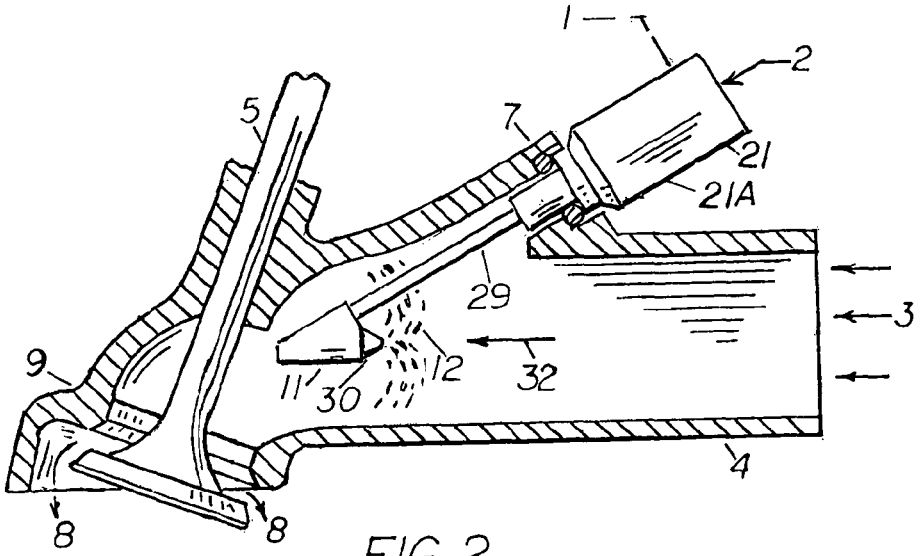
FIG. 2 shows a typical but not limiting countercurrent fuel injector assembly 21A installed according to this invention.

In this invention, injector valve 21 in FIG. 2 performs only one function. It acts as an on-off valve to meter fuel 2 as called for by a pulsating electrical signal 1 from the engine's controller. An extension 33 in FIG. 3 is attached to injector valve 21 to place nozzle 30 so that spray 12 in FIG. 2 is counter-current into peak velocity combustion air 32.

Because injector valve 21 is in series with nozzle 30 in FIG. 2, its pressure drop at designed fuel flow rate should be the least that allows injector valve 21 to have its necessary operating speed. Injector valve 21 may be especially made, or from a larger engine such as a stock car application. In some cases injector valve 21's pintel 23 in FIG. 3 can be ground away to increase capacity. Because of pressure drop through injector valve 21 and extension 33, fuel supply pressure 2 in FIG. 2 should be increased as needed to maintain design pressure to nozzle 30. An outlet glue surface 22 of injector valve 21 in FIG. 3 should be prepared as needed for glue joining to glue surface 18 of extension 33.

Figure 3:
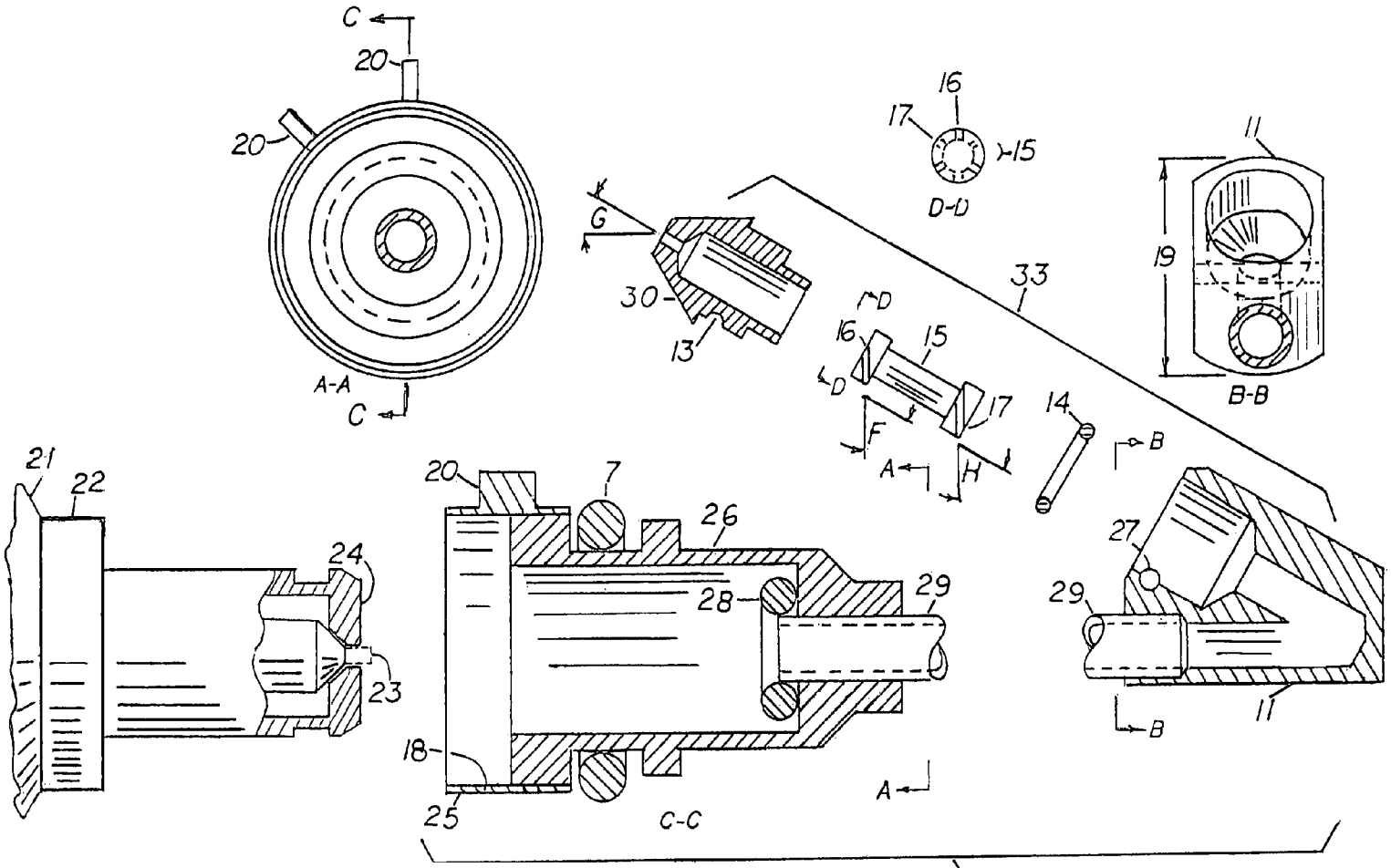
FIG. 3 shows an exploded view of a typical fuel injector extension 33.

FIG. 3 shows an exploded view of extension 33. All metal and plastic parts should resist corrosion in the atmosphere and temperatures encountered in the cylinder's intake manifold. All fuel flow inlet surfaces such as tube 29, slots 16 and nozzle orifice 31 should be smooth and rounded. "O" rings are preferred for gaskets wherever temperature limitations for the rings are not exceeded.

Extension 33 in FIG. 3 has an adaptor 26 which is welded to a connector 25 of a material suitable for a glue joint between injector valve 21's glue surface 22 and connector 25's glue surface 18. Connector 25 also carries indexing tabs 20. These tabs are spaced so that only the correct injector will fit into matching slots on its particular port. Adaptor 26 uses an "O" ring 7 as its seal in an injector port. A second "O" ring 28 seals adaptor 26 to surface 24 of injector valve 21 when they are joined. An extension tube 29 is welded to adaptor 26 and to a reversing block 11.

Block 11 in FIG. 3 is made at an angle G to direct fuel spray 12 directly counter-current into peak velocity of combustion air flow 32 in FIG. 2. Extension 29 may be bent and or extended as needed to inject fuel spray at a lateral point of maximum combustion air velocity. Fuel drainage from nozzle 30 may be a problem for some, especially large, engines. If such is the case, extension 29 may also be shaped as needed to create a spot at or near block 11 that is lower (a trap) than outlet 31 of nozzle 30.

Reversing block 11 in FIG. 3 is limited in size to a dimension 19 which must pass through its cylinder's injector port. Block 11's inlet is drilled to receive the outlet of extension 29. The outlet of block 11 is drilled to receive a spinner 15, an "O" ring 14 and nozzle 30. Evenly spaced angular grooves 16 in spinner 15 spin the fuel which causes it to spread into a cone as it leaves orifice 31.

Spray nozzle 30 in FIG. 3 includes a spinner 15 as a means to produce an included spray cone angle of approximately 20 to 40 degrees as fuel leaves orifice 31. However, a less or greater spray angle may be needed depending upon air velocity, injection timing relative to intake valve timing, manifold pressure and the use of sequential or simultaneous port injection. The desired final result is for fuel to move quickly in all lateral directions from the outlet of orifice 31 toward the wall of intake manifold 4. Spinner 15 which is shaped like a barbell has multiple angled cuts 16 and 17 in each end. Cuts 16 at its outlet are angled F at approximately 60 degrees. Total cross sectional area for cuts 16 should be approximately 4 times the cross sectional area of nozzle outlet 31. The combined cross section area of cuts 16 can be changed to vary the included spray cone angle 12 in FIG. 2. Reduce the combined area of cuts 16 to increase the angle of spray 12. Also, throat length of orifice 31 in FIG. 3 will effect spray cone angle. A common throat length is 1 orifice diameter. A longer throat length reduces the angle of spray cone 12. Cuts 17 at spinner 15's inlet align spinner 15 coaxially in nozzle 30, and their total open area is six or more times the area of outlet 31 to avoid any significant flow restriction. An angle H for cuts 17 is not critical, since the main function of end 17 is to align cuts 16 and offer no obstruction to flow. The end of spinner 15 at cuts 17 also serves as a location to "stake", for example, spinner 15 to nozzle 30 so that spinner 15 will not rotate in response to fuel flow.

If supply pressure 2 in FIG. 1 is 42 psi. and pressure drop across injector valve 21 and extension 33 up to nozzle 30 is 6 psi. then pressure 2 in FIG. 2 should be increased to 48 psi. This results in the same atomizing pressure for nozzle 30 in FIG. 2 as for injector 6 in FIG. 1.

An "O" ring 14 in FIG. 3 seals nozzle 30 at reversing block 11. During assembly, an axial force between nozzle 30 and block 11 is used to compress "O" ring 14 to avoid fuel leakage. For example, if fuel pressure at 2 in FIG. 2 is 48 psi. and the area of "O" ring 14 is 0.1 sqin. then minimum axial force is 4.8 pounds. Actual force should be greater. While this compressive force is being applied to nozzle 30 and block 11 in FIG. 3 against "O" ring 14, a notch 13 in nozzle 30 is drilled using "pin" hole 27 as a guide. A pin installed through hole 27 and notch 13 secures nozzle 30 to block 11 while "O" ring 14 is in compression. A pin in hole 27 should be staked only after all final tests on injector assembly 21A are satisfactory.

The use of "O" ring 14 in FIG. 3 as a gasket to seal nozzle 30 at reversing block 11 may not be satisfactory for applications where excessive temperatures are encountered. In such cases, a welded or silver solder joint between nozzle 30 and reversing block 11 is more suitable. However, cleaning nozzle 30 or altering spray pattern 12 becomes much more difficult.

If injector assembly 21A in FIG. 2 is to replace injector 6 in FIG. 1, it should have comparable fuel flow capacity, spray droplet characterization and operating speed. Extension 33 should be made into a sub-assembly from all parts in FIG. 3 except valve 21. After injector valve 21 and extension sub-assembly 33 have been tested separately for capacity, operating speed, leaks, tight shut-off and spray pattern, injector valve 21 is joined to completed extension 33. Glue surface 22 on injector valve 21 is glued to glue surface 18 of coupling ring 25. An "O" ring 28 seals against injector surface 24 The glue joint between 18 and 22 must be make with a longitudinal compressive force greater than the longitudinal force that will result from maximum fuel pressure.

Assembled injector 21A should be re-tested for capacity, tight shut-off, leakage, operating speed and spray pattern before installing in an engine.

The effectiveness of countercurrent fuel injection can be monitored by measuring temperature rise across a vehicle's catalytic converter and comparing to conventional fuel injection in the same vehicle under the same simulated or real road conditions.

The invention claimed is:

1. A fuel injector assembly for mixing a jet of fuel spray and a flow of air in a combustion engine comprising, an injector valve;

an extension coupled to the injector valve;

a reversing block coupled to the extension; and a nozzle coupled to the reversing block, the nozzle being configured to direct the jet of fuel axially countercurrent to the flow of air in the combustion engine.

2. The fuel injector assembly of claim 1, wherein the extension is bent to position the nozzle in the center of an air duct and aim the nozzle axially countercurrent to the flow of air when the flow of air is at its peak velocity.

3. The fuel injector assembly of claim 1, further comprising a spinner configured for positioning between the nozzle and the reversing block.

4. The fuel injector assembly of claim 3, wherein the spinner is configured to angularly direct the jet of fuel upon exit of the jet of fuel from the nozzle.

5. A method for mixing a pressurized fine fuel spray for a fuel from a power controlled valve with a fuel combustion air for the fuel for an internal combustion cylinder in an air duct before and adjacent to a cylinder intake valve and during an intake cycle of the cylinder intake valve, the method comprising:

mounting of a spray nozzle before and adjacent to the cylinder intake valve and injecting the fuel spray from the nozzle axially and countercurrent to peak velocity of the fuel combustion air so that initial relative velocity between the fuel spray and said air is maximum.

6. The method of claim 5, wherein sprayed droplets of the fuel spray are fine enough to be deflected laterally in all directions from an outlet of a countercurrent nozzle toward the perimeter of the air duct by peak velocity combustion air.

7. The method of claim 5, wherein an extending and directional element following a powered fuel valve places the spray nozzle aimed axially and countercurrent to peak velocity of incoming combustion air in its duct and adjacent to an intake valve.

8. A countercurrent fuel injector assembly for an internal combustion engine, comprising:

an electrically operated off-on fuel valve, said valve embodying a glue surface, an adaptor, said adaptor embodying a connector, said connector embodying a glue surface and indexing tabs, said adaptor being welded to a connecting tube, said tube being welded and connected to a reversing bock, a spray nozzle embodying a staked in place spinner, said spray nozzle being pin connected and gasket sealed or welded to said reversing block, said valve being suitable for operation by a power control system of an engine, said valve being glue joined and gasket sealed to said adaptor, said adaptor embodying a gasket seal between said adaptor and an injector port from the engine, said indexing tabs being unique to fit matching notches in an injector port of a matching injector, said tube being curved and said reversing block being oriented to axially direct said fuel countercurrent to peak combustion air and to place the bend of said reversing block below the outlet of said spray nozzle.

* * * * *